US006523323B2

(12) United States Patent
Worley

(10) Patent No.: US 6,523,323 B2
(45) Date of Patent: Feb. 25, 2003

(54) METHOD AND APPARATUS FOR GANGING TOGETHER CONCRETE FORMS

(75) Inventor: Ross W. Worley, Kansas City, MO (US)

(73) Assignee: Wall-Ties & Forms, Inc., Shawnee, KS (US)

( * ) Notice: Subject to any disclaimer, the term of this patent is extended or adjusted under 35 U.S.C. 154(b) by 0 days.

(21) Appl. No.: 09/910,230

(22) Filed: Jul. 20, 2001

(65) Prior Publication Data

US 2003/0014933 A1 Jan. 23, 2003

(51) Int. Cl.[7] ..... E04B 1/00
(52) U.S. Cl. ..... 52/745.09; 249/191
(58) Field of Search ..... 52/745.09; 249/38, 249/40, 47, 190, 191, 192, 193, 45, 44, 219.2

(56) References Cited

U.S. PATENT DOCUMENTS 1,228,037 A * 5/1917 McKay ..... 52/745.09
3,481,575 A * 12/1969 Arrighini ..... 249/191 X
4,643,387 A * 2/1987 Bo ..... 249/193
6,361,014 B1 * 3/2002 Lopez ..... 249/45

OTHER PUBLICATIONS

Wall–Ties & Forms, Inc. Product Catalog, p. 31 (undated).

* cited by examiner

*Primary Examiner*—David M. Purol
(74) *Attorney, Agent, or Firm*—Shook, Hardy & Bacon L.L.P.

(57) ABSTRACT

A form assembly is constructed from a plurality of wall panels joined in side by side relationship by interposed adapters. The adapters have end plates in which reliefs are formed to accommodate alignment walers that extend along the top and bottom of the form assembly to maintain planar alignment of the form assembly. The reliefs allow the walers to be recessed so that they do not extend beyond the horizontal plane of the top and bottom of the wall panels. The form assembly is used to create a form in which concrete is poured to create a concrete wall, such as a foundation wall for a house. Because the form assembly can be installed and removed as a single piece rather than multiple individual wall panels, the time required to erect and remove the form is reduced.

15 Claims, 4 Drawing Sheets

METHOD AND APPARATUS FOR GANGING TOGETHER CONCRETE FORMS

BACKGROUND OF THE INVENTION

This invention is directed generally to methods and apparatus useful in pouring of concrete walls and, more particularly, to concrete wall forms and methods employing same.

Concrete forms are available in various standard sizes and are normally joined together at the job site to create the various lengths and angles needed for the concrete wall being formed. Joining together and then, after the concrete has hardened, disassembling the numerous forms typically required for a concrete wall, such as a foundation wall for a house, is a labor-intensive and time-consuming task. The need to maintain alignment of the forms while under pressure from the poured concrete has led to the development of walers, or alignment bars, that are positioned within brackets secured to the back side of the forms and extend along a plurality of adjacent forms to resist bowing or other displacement of the forms. In some applications, walers have been secured along the tops of several adjacent forms, thereby allowing the several forms to be installed and removed at a job site while being joined together. Although the use of the waler for this purpose is beneficial because it reduces the installation and removal time, the waler is positioned above the tops of the forms and interferes with the vertical stacking of two or more forms as is sometimes required in connection with the forming of taller concrete walls. Moreover, the waler has not been positioned along the bottom of the forms because it would cause the bottom of the forms to be raised above level of the footers or other surface on which the forms are placed. As a result, in order to obtain the desired alignment of the bottoms of the forms, a chalk line must sometimes be placed on the footer and the forms are then aligned with the chalk line and nailed into place. It can be appreciated that aligning the forms in this manner adds significantly to the time required for installation.

A need has thus developed for a way to join together a plurality of forms to simplify their alignment as well as their installation and removal without interfering with the ability to stack one form on top of another.

SUMMARY OF THE INVENTION

In one aspect, the present invention is directed to a form assembly for use in forming a poured concrete wall. The form assembly is constructed from a plurality of wall panels which are aligned in planar relationship with adapters interposed between the wall panels and along the free sides thereof. Each said wall panels comprises a frame having spaced apart side rails and a top and a bottom, as well as a face sheet applied to the frame and presenting a surface against which concrete is poured. The adapters are joined to the side rails of adjacent wall panels, and each comprises spaced apart sides and spaced apart upper and lower end plates positioned at the top and bottom of the adapter. Each adapter further includes a face plate applied to the sides of the adapter and presenting a surface against which concrete is poured. A relief is forced in the upper end plates and preferably also the lower end plates of each adapter opposite from the face plate. Walers are positioned within the reliefs and are joined to the respective end plates. The walers extend along and maintain horizontal and vertical planar alignment of the wall panels and the adapters. The relief allows the walers to be recessed sufficiently so that they do not extend beyond the horizontal plane defined by the top and bottom of the wall panels. As a result, the walers do not interfere with either the positioning of the form assembly on a surface such as a footer or the stacking of one form assembly on top of another.

In another aspect, the invention is directed to using the form assembly described above to form an open space in which concrete is poured to create a wall, such as a foundation wall for a house. The form assembly is installed and removed as a single unit, thereby greatly reducing the time and effort that would otherwise be required to install and remove the individual wall panels.

BRIEF DESCRIPTION OF THE DRAWINGS

In the accompanying drawings which form part of the specification and are to be read in conjunction therewith and in which like reference numerals are used to indicate like parts in the various views.

DESCRIPTION OF THE PREFERRED EMBODIMENTS

Figure 1:
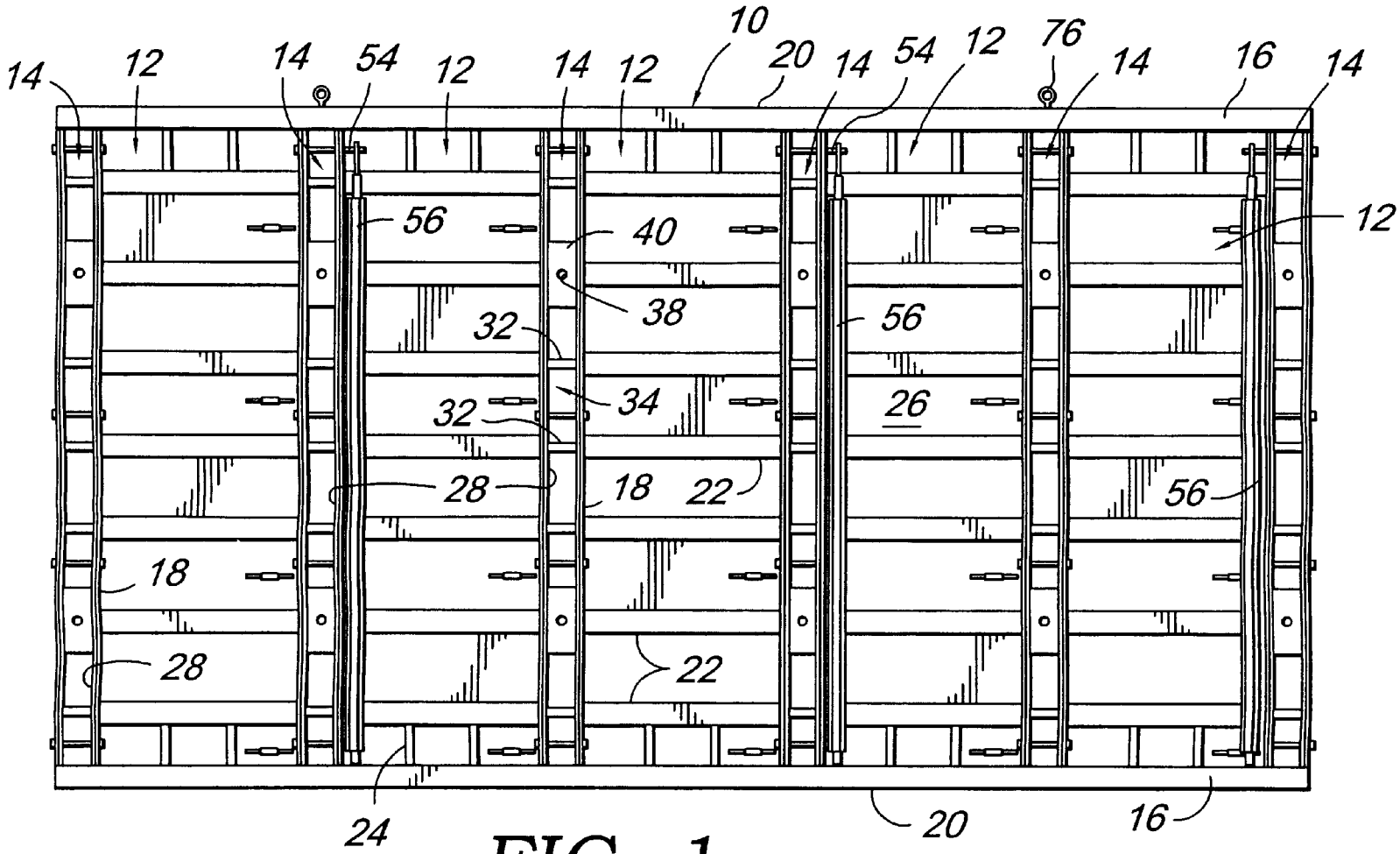
FIG. 1 is an elevation view of a form assembly constructed in accordance with the present invention.

Referring now to the drawings in greater detail, and initially to FIG. 1, a form assembly useful in forming poured concrete walls is-represented generally by the numeral 10. Form assembly 10 comprises a plurality of individual wall panels 12 joined together in side by side relationship by interposed adapters 14 and maintained in planar alignment by walers 16 extending along the top and bottom of the assembly 10.

Each wall panel 12 may advantageously be of a conventional construction and includes a pair of spaced apart side rails 18 and a pair of end rails 20 that extend between and are joined to the top and bottom ends of the side rails 18 to form a rectangular frame. A plurality of spaced apart cross braces 22 extend between the side rails 18 to provide added structural rigidity to the frame. Mullions 24 may likewise extend between the cross braces 22 and the end rails 20 for increased rigidity. A face sheet 26 extends across the width and height of the panel frame and presents a smooth or textured surface which contacts the poured concrete during use of the panels 12. A known releasing agent may be applied to the surface of the face sheet 26 to facilitate separation of the face sheet 26 from the hardened concrete.

The adapters 14 which join together adjacent pairs of wall panels 12 comprise spaced apart side rails 28 and upper and lower end plates 30 that join the top and bottom ends of the side rails 28. A plurality of cross braces 32 extend between the side rails 28 at regularly spaced intervals and a face plate 34 is joined to the rails 28 and 30 and braces 32 to present a smooth or textured surface for contact with the poured concrete. The face plate 34 is coplanar with the face sheets of the adjacent wall panels 12 when the adapter 14 is joined to the wall panels 12. A cutout 35 is provided in the front lower edge of the upper end plate 30 and the front upper edge of the lower end plate 32 to receive and protect the top and bottom edges of the face plate 34.

Figure 2:
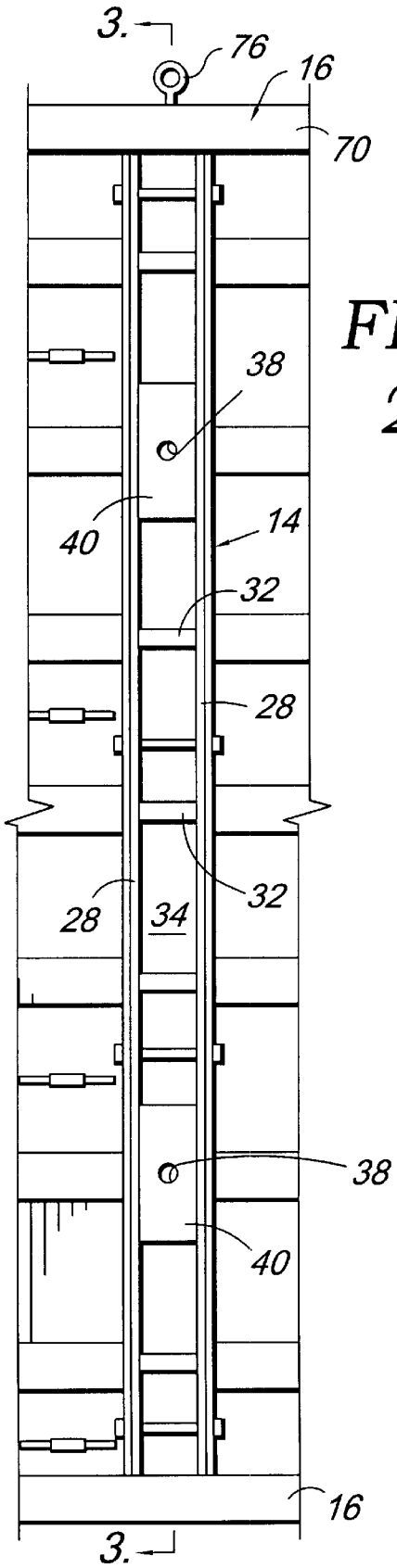
FIG. 2 is an enlarged, fragmentary elevation view of the form assembly shown in FIG. 1.
Figure 3:
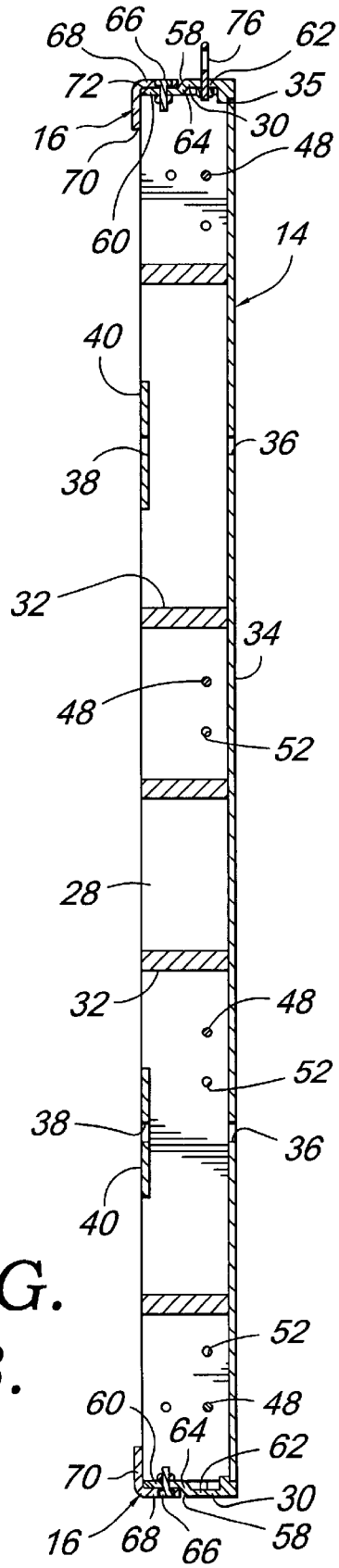
FIG. 3 is a side elevation view of the form adapter taken in vertical section along line 3—3 of FIG. 1 in the direction of the arrows.
Figure 6:
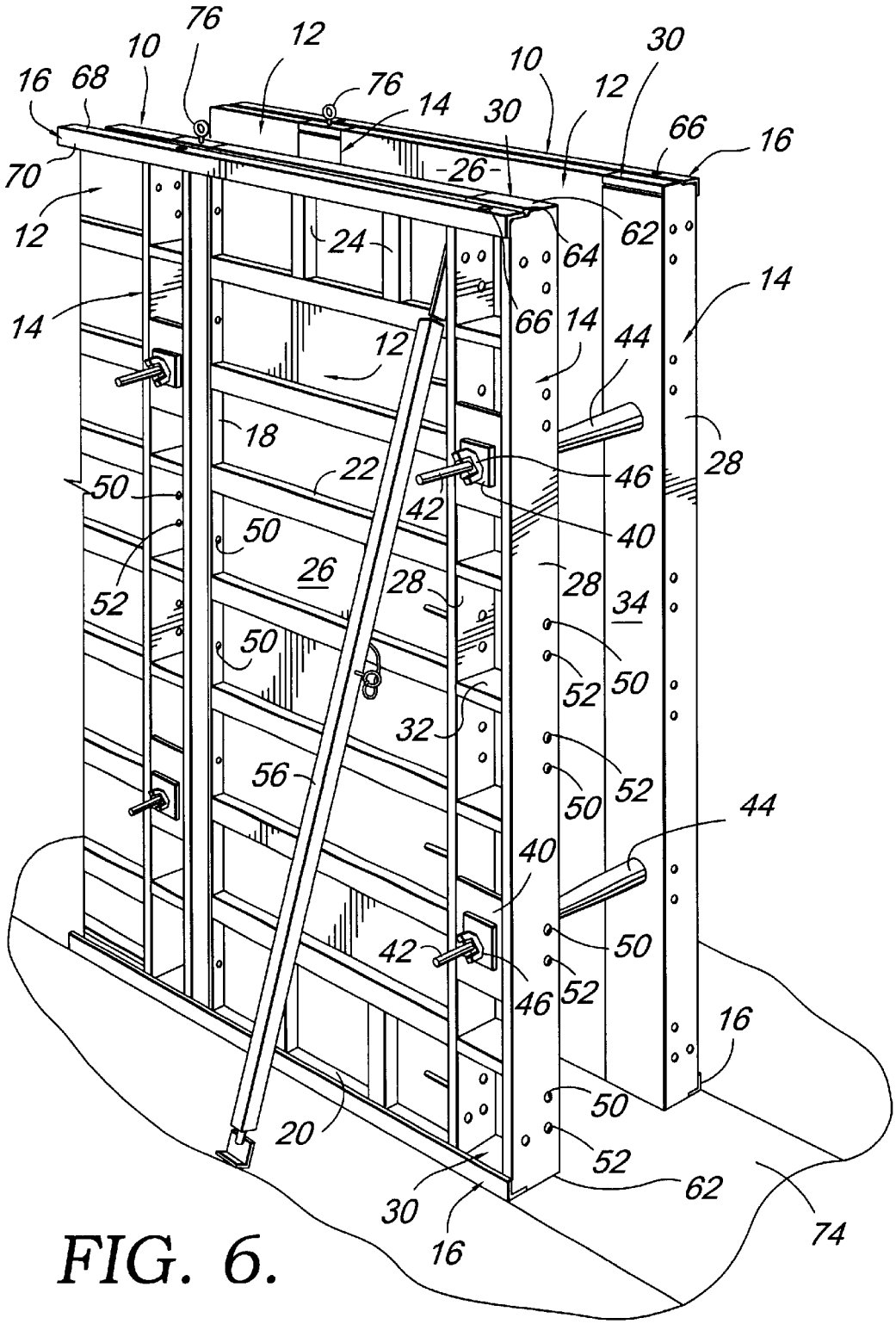
FIG. 6 is an end perspective view of a pair of form assemblies which have been set up to allow for pouring a concrete wall in the open space between the form assemblies.

As is best shown in FIGS. 2 and 3, each adapter 14 includes at least two tie rod openings 36 in the face plate 34 and aligned openings 38 in a backer plate 40 to allow tie rods 42 to be inserted through the adapters 14 in spaced apart form assemblies 10, as shown in FIG. 6. The tie rods 42 function to maintain the form assemblies 10 in place during the pouring of concrete into the open space between the form assemblies 10. An elongated cone-shaped spacer 44 is placed on each tie rod 42 as it is inserted through the spacing between the form assemblies 10 to maintain the desired distance of separation between the form assemblies. Wing nuts 46 are then threaded onto both ends of the tie rods and are tightened against the backer plate 40 to maintain the face plates 34 of the adapters 14 in contact with the ends of the spacer 44.

Figure 5:
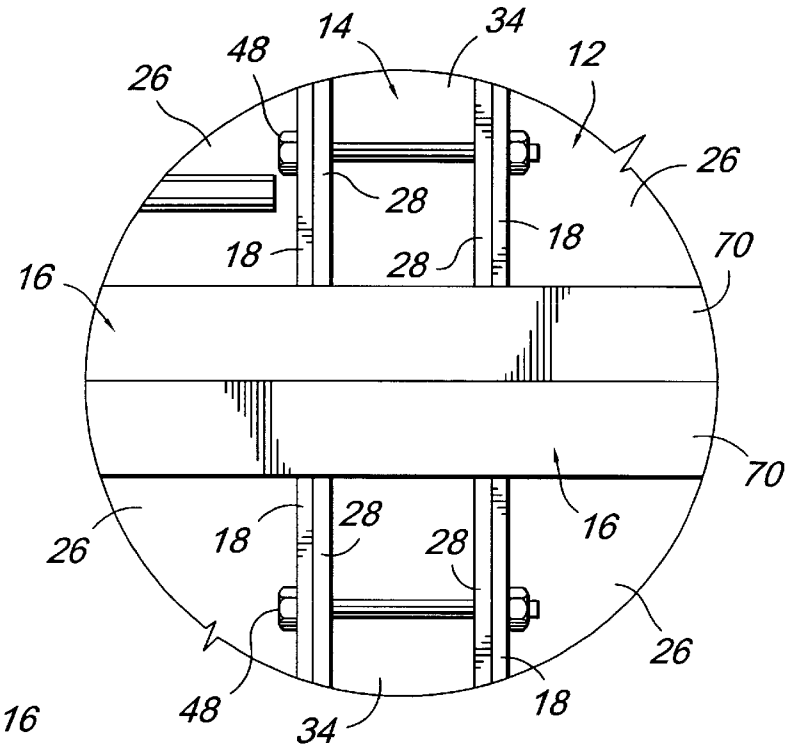
FIG 5 is an enlarged, fragmentary, elevation view of the form assemblies taken within the circle designed by the numeral 5 in FIG. 4.

As can be seen in FIGS. 1, 5 and 6, the adapters 14 are joined to the wall panels 12 by inserting fasteners 48 through aligned holes 50 provided in the side rails 18 and 28 of the wall forms 12 and adapters 14, respectively. To better illustrate the holes 50, the fasteners 48 have been removed from FIG. 6. The fasteners 48 may be of any suitable type such as pin and wedge fasteners or, more preferably, bolts that extend from one wall panel 12 through an adapter and into the adjacent wall panel 12 where they are secured by a nut. Because different types of standardized wall panels 12 have different patterns of holes 50, additional holes 52 are preferably provided in the adapter side rails 28 to allow the adapters 14 to be used with more than one type of wall panel 12. As can best be seen in FIG. 1, additional fasteners 54 are used to mount- telescoping and screw-type extensible braces 56 that are deployed to maintain vertical alignment of the form assembly 10 during set up and use.

The adapters 14 are sized, in most applications, so that their height is the same as the wall panels 12 and their front to back depth is roughly twice that of the wall panels 12. The width of the adapters 14 is preferably substantially less than the width of the wall panels 12. For example, adapters 14 with a six inch width may be used with thirty-six inch wide wall panels 12, thereby providing a horizontal spacing of forty-two inches between adjacent tie rods 42. In other applications, the adapters 14 have a width of twelve inches. Other sizes are possible as well.

The waler 16 is of a length sufficient to extend from one end of the form assembly to the other end. The preferred material for waler 16, as well as the other components of the form assembly 10, is aluminum because of its strength and light weight. Other metals and materials can, of course, be used.

In accordance with the present invention, the adapters 14 are constructed in a manner which allows walers 16 to extend along the top and bottom of the form assembly 10 without causing the height of the form assembly 10 to be increased beyond the height of the wall panels 12. As best shown in FIG. 3, this is accomplished by forming a relief 58 in the adapter end plates 30 and positioning the waler 16 within the relief 58. The relief 58 is formed by offsetting a segment 60 of the end plate 30 from the plane of a main segment 62 of the end plate. The offset and main segments 60 and 62 are connected by an inclined wall 64 that is generally positioned midway between the front and back edges of the end plate 30. The inclined wall 64 is preferably positioned so that the horizontal dimension of the second segment 62 is equal to or greater than the thickness of the wall panels 12 so that a slight gap is present between the waler 16 and the wall panels 12.

The waler 16 is normally formed of angled metal stock and is secured by fasteners 66 to the top surface of the offset segment 60 of end plate 30. The fasteners 66 are preferably countersunk and extend through holes (not shown) formed in one leg 68 of the waler 16 while the other leg 70 of the waler 16 bears against the side rails 28 of the adapters 14 to maintain the plurality of adapters 14 in each form assembly 10 in planar alignment. In order to allow the waler 16 to fit snugly against the side rails 28, the front to back dimension of the offset segment 60 is equal to or greater than the corresponding dimension of the waler leg 68 and the back upper edge of the end plate 30 has a slight bevel 72 to accommodate the slight radius at the 90 degree bend on the undersurface of the waler 16.

Figure 4:
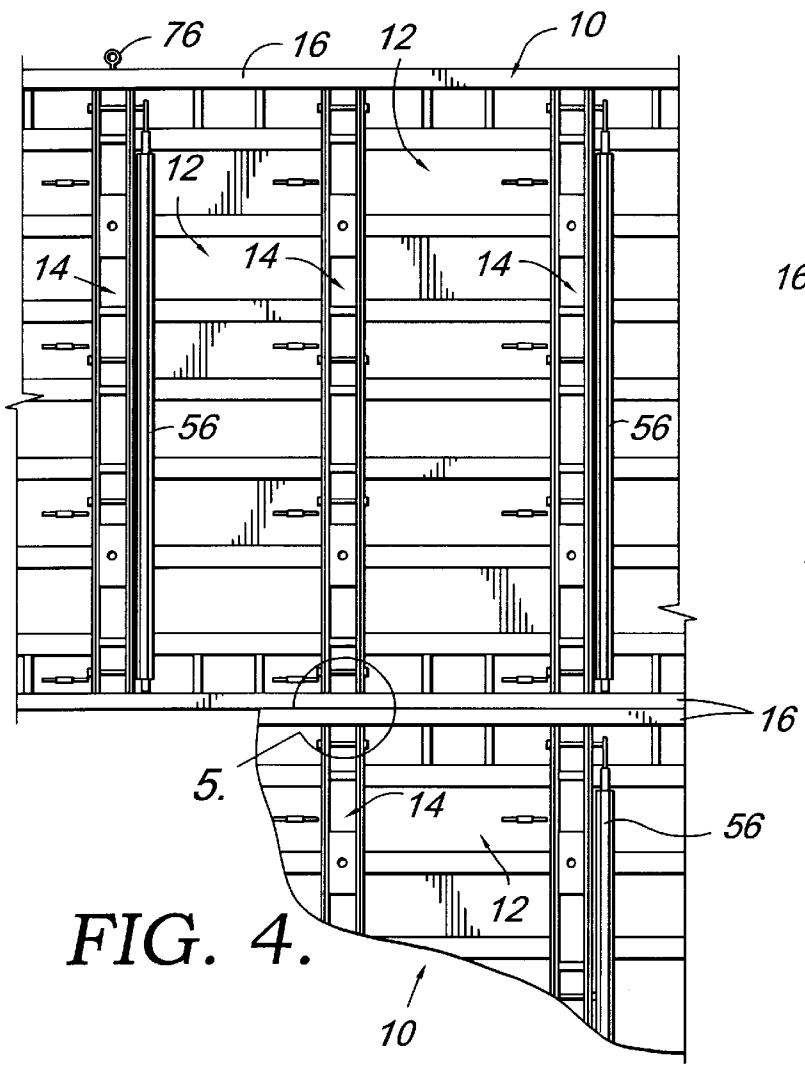
FIG. 4 is a fragmentary, back elevation view of a pair of form assemblies stacked one on top of the other.

The vertical displacement of the offset and main segments 60 and 62 of end plate 30 is sufficient to ensure that the waler 16 and fasteners 66 do not extend beyond the horizontal plane of the main segment 62 and the end rails 20 of the wall panels 12. This prevents the waler 16 from interfering with the placement of the lower end rails 20 of the wall panels 12 on footers 74 (FIG. 6) and allows stacking of two or more form assemblies 10 as illustrated in FIGS. 4 and 5.

In order to facilitate lifting of the form assembly 10 by a boom truck or other equipment, eye-bolts 76 are removable installed through the end plates 30 of spaced apart adapters 14.

The form assemblies 10 are constructed by first joining together a plurality of wall panels 12 and interposed adapters 14 using fasteners 48. The walers 16 are then positioned in the reliefs 58 formed in the end plates 30 of the adapters and are secured by fasteners 66. The depending leg 70 of each waler 16 bears against the side rails 28 of each adapter 14 to cause and maintain planar alignment of the adapters 14 and associated wall panels 12. The other leg 68 of the waler 16 bears against the end plates 30 of the adapters 14 to also cause and maintain horizontal alignment of the ends of the adapters 14 and wall panels 12. Once the desired planar alignment of the form assembly 10 has been obtained, the eye-bolts 76 may be installed to facilitate lifting of the form assembly, such as by a boom truck.

In use, one or more form assemblies 10 are delivered to a job site and placed into the desired position for forming a poured concrete wall. For example, as illustrated in FIG. 6, two form assemblies 10 are positioned on the prepoured concrete footer 74 in spaced apart relationship to create an open space in which concrete can be poured to form a concrete wall or other structure. Although only two form assemblies 10 are shown for illustration purposes, it will be appreciated that additional form assemblies 10 and/or hand-set forms are normally joined in side-by-side or angled relationship to those illustrated, such as in the formation of a foundation wall for a house or other structure. Tie rods 42 and spacer cones 44 are then installed to maintain the desired spacing between the spaced apart form assemblies 10.

After the concrete wall has been poured and has hardened sufficiently, the tie rods 42 are removed and the form assemblies 10 can be removed and transported to another job site for use. Notably, the use of form assemblies 10 containing a plurality of preassembled wall panels 12 greatly reduces the time required to install and remove the wall panels 12 at the job site. The positioning of walers 16 within reliefs 58 is particularly advantageous because it allows walers to be positioned at both the top and the bottom of the form assembly to maintain the desired alignment without adding to the height of the wall panels 12 or interfering with the stacking of form assemblies 10 as shown in FIGS. 4 and 5 to create taller concrete walls. In conventional form assemblies, the waler is either attached to and extends above the top of the wall panels, thereby preventing stacking of the wall panels, or is mounted by braces to the outside of wall panels.

The ability to utilize a waler 16 along the bottom of the form assembly 10 is particularly advantageous because it eliminates the need to install a chalk line on the footer 74, align the bottom edge of each wall panel with the chalk line, and then nail or otherwise secure the end rails of the wall panels to the footer 74 as is sometimes the case with conventionally joined wall panels.

The adapters 14 are also advantageous in that they allow conventional wall panels 12 to be used in constructing form assemblies 10.

From the foregoing it will be seen that this invention is one well adapted to attain all ends and objects hereinabove set forth together with the other advantages which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. A form assembly for use in forming a poured concrete wall comprising:

a plurality of wall panels aligned in planar relationship, each of said wall panels comprising a frame having spaced apart side rails and a top and a bottom, each of said wall panels further comprising a face sheet applied to said frame and presenting a surface against which concrete is poured;

adapters interposed between said wall panels and along the side rails which are not adjacent to another wall panel, said adapters being joined to the side rails of adjacent wall panels, each of said adapters comprising spaced apart sides and spaced apart upper and lower end plates positioned at the top and bottom of the adapter, said adapter further comprising a face plate applied to said sides of the adapter and presenting a surface against which concrete is poured, said sides of the adapters being joined by first fasteners to the adjacent side rails of the wall panels;

a relief formed in said upper end plates of each adapter opposite from said face plate; and an upper waler positioned within said reliefs and joined to said upper end plates, said waler extending along and maintaining planar alignment of the wall panels and the adapters.

2. The form assembly of claim 1, wherein said reliefs are formed in both said upper and lower end plates and wherein a lower waler is positioned within said reliefs in the lower end plates and is joined to said lower end plates.

3. The form assembly of claim 2, wherein each of said reliefs is formed by a recessed segment of said associated upper or lower end plate and wherein at least said lower waler does not extend beyond a horizontal plane defined by the bottoms of the wall panels.

4. The form assembly of claim 3, wherein said upper and lower walers each comprises a first leg secured by second fasteners to said associated upper or lower end plate and a second leg extending in contact with the sides of the adapters opposite from the face plate.

5. The form assembly of claim 4, wherein said face plates of the adapters are coplanar with the face sheets of the wall panels.

6. The form assembly of claim 5, including tie rod openings formed in the face plates of the adapters to allow tie rods to be inserted through said face plates.

7. The form assembly of claim 6, wherein said first fasteners are releaseable to allow said adapters to be separated from said adjacent wall panels.

8. An adapter assembly for joining together two or more wall panels in planar alignment, said wall panels each comprising a frame having spaced apart side rails and a top and a bottom, each of said wall panels further comprising a face sheet applied to said frame and presenting a surface against which concrete is poured, said adapter assembly comprising:

an adapter for positioning between and being joined to said wall panels or along the side rails which are not adjacent to another wall panel, said adapter comprising spaced apart sides and spaced apart upper and lower end plates positioned at the top and bottom of the adapter, said adapter further comprising a face plate applied to said sides of the adapter and presenting a surface against which concrete is poured;

a relief formed in said upper end plate of the adapter opposite from said face plate; and an upper waler for positioning within said relief and being joined to said upper end plate, said waler being of a length to extend along and maintaining planar alignment of the wall panels and the adapter.

9. The adapter assembly of claim 8, including reliefs formed in both said upper and lower end plates and including a lower waler for positioning within said relief in the lower end plate and being joined to said lower end plate.

10. The adapter assembly of claim 9, wherein each of said reliefs is formed by a recessed segment of said associated upper or lower end plate and wherein at least said lower waler does not extend beyond a horizontal plane defined by the bottoms of the wall panels when joined to the adapter by first fasteners.

11. The adapter assembly of claim 10, wherein said upper and lower walers each comprises a first leg secured by second fasteners to said associated upper or lower end plate and a second leg extending in contact with the sides of the adapter opposite from the face plate.

12. The adapter assembly of claim 11, wherein said face plate of the adapter is coplanar with the face sheets of the wall panels when joined to the adapter.

13. The adapter assembly of claim 12, including tie rod openings formed in the face plate of the adapter to allow tie rods to be inserted through said face plate.

14. The adapter assembly of claim 13, wherein said first fasteners are releasable to allow said adapter to be releaseably joined to said adjacent wall panels.

15. A method of forming a poured concrete wall comprising:

installing a pair of forming assemblies of claim 1 in spaced apart and facing relationship to create an open space between the face sheets;

pouring concrete in said open space;

allowing said concrete to harden; and separating said forming assemblies from the hardened concrete and removing each forming assembly as a single unit for reuse.

* * * * *